US009963874B2

(12) United States Patent
Weeks

(10) Patent No.: US 9,963,874 B2
(45) Date of Patent: May 8, 2018

(54) MULTI ANGLE ROOF TRUSS TIE-DOWN APPARATUS AND METHOD

(75) Inventor: Kevin Weeks, Elizabeth (AU)

(73) Assignee: Weeks Holdings Pty Ltd, Elizabeth (AU)

( * ) Notice: Subject to any disclaimer, the term of this patent is extended or adjusted under 35 U.S.C. 154(b) by 27 days.

(21) Appl. No.: 14/236,816

(22) PCT Filed: Aug. 6, 2012

(86) PCT No.: PCT/AU2012/000921

§ 371 (c)(1),
(2), (4) Date: Feb. 24, 2014

(87) PCT Pub. No.: WO2013/016773

PCT Pub. Date: Feb. 7, 2013

(65) Prior Publication Data

US 2014/0157686 A1 Jun. 12, 2014

(30) Foreign Application Priority Data

Aug. 4, 2011 (AU) ..... 2011205150

(51) Int. Cl.

| | |
|---|---|
| ***E04B 7/04*** | (2006.01) |
| ***E04B 1/24*** | (2006.01) |
| ***E04B 7/06*** | (2006.01) |
| *E04C 3/04* | (2006.01) |

(52) U.S. Cl.

CPC ..... *E04B 7/045* (2013.01); *E04B 1/24* (2013.01); *E04B 7/04* (2013.01); *E04B 7/063* (2013.01); *E04B 2001/249* (2013.01); *E04B 2001/2439* (2013.01); *E04B 2001/2448* (2013.01); *E04C 2003/0482* (2013.01)

(58) Field of Classification Search

CPC ... E04B 7/045; E04B 7/04; E04B 7/06; E04B 7/063; E04B 1/24; E04B 1/2403; E04B 1/2608; E04B 2001/2448; E04B 2001/2439; E04B 2001/2499; E04B 2001/2415; E04B 2001/2418; E04B 2001/2421; E04B 2001/2616; E04B 2001/2644; E04B 2001/2648; E04B 2001/266; E04C 3/02; E04C 3/04; E04C 2003/0482; E04C 2003/0404; E04C 2003/0465

See application file for complete search history.

(56) References Cited

U.S. PATENT DOCUMENTS

| | | | | | |
|---|---|---|---|---|---|
| 1,787,167 | A | * | 12/1930 | Purdy | 403/58 |
| 1,986,980 | A | * | 1/1935 | Ross | 403/376 |
| 4,015,399 | A | * | 4/1977 | Prins | 52/745.02 |
| 4,041,659 | A | * | 8/1977 | McElhoe | 52/93.1 |
| 4,102,108 | A | * | 7/1978 | Cody | 52/693 |
| 4,309,857 | A | * | 1/1982 | Lovering | 52/632 |
| 4,381,635 | A | * | 5/1983 | Solo | 52/639 |
| 4,503,651 | A | * | 3/1985 | Pugh | 52/639 |

(Continued)

FOREIGN PATENT DOCUMENTS

| | | | | |
|---|---|---|---|---|
| GB | 690499 | | 4/1953 | |
| GB | 2431973 | * | 5/2007 | E04B 1/24 |

*Primary Examiner* — Jessica L Laux
(74) *Attorney, Agent, or Firm* — Sand & Sebolt

(57) ABSTRACT

The present invention relates to a roof truss tie-down apparatus including a pin and bracket engagement which enables a wall frame to accommodate any style of roof truss at any angle, and a method of constructing such a roof frame.

10 Claims, 8 Drawing Sheets

(56) References Cited

U.S. PATENT DOCUMENTS

| | | | | |
|---|---|---|---|---|
| 4,697,393 | A * | 10/1987 | Madray | 52/93.2 |
| 4,872,297 | A * | 10/1989 | Hetzel et al. | 52/91.1 |
| 5,230,198 | A * | 7/1993 | Callies | 52/702 |
| 5,729,948 | A * | 3/1998 | Levy et al. | 52/656.9 |
| 2006/0059794 | A1* | 3/2006 | Gilstrap et al. | 52/90.1 |
| 2007/0011965 | A1* | 1/2007 | Olson | E02D 27/42 52/293.3 |
| 2008/0098669 | A1* | 5/2008 | Lin | E04B 7/045 52/92.2 |
| 2011/0005144 | A1* | 1/2011 | McDougall | 52/79.1 |

* cited by examiner

MULTI ANGLE ROOF TRUSS TIE-DOWN APPARATUS AND METHOD

FIELD OF THE INVENTION

The present invention relates to a roof truss tie-down apparatus including a pin and bracket engagement which enables a wall frame to accommodate any style of roof truss at any angle. The invention further relates to a building frame assembly incorporating the tie down apparatus, and a method of roof construction using the tie-down apparatus.

BACKGROUND TO THE INVENTION

Roof trusses used in the building industry are usually fashioned from steel or timber, fabricated in a factory, and assembled together on-site. Such assembly usually involves connection of the roof trusses to the frame of the building through conventional fixing systems such as bolts, screws, nails or rivets. It is quite common for roof trusses to need to be fitted at an angle other than perpendicular to the wall frame.

Many styles of roofing such as hipped roofs include direct inter-connection of roof trusses. To achieve this, the first truss is usually braced into position and further roof trusses are added until the roof frame is completed and self-supporting.

However, these methods typically require the fastening of each roof truss to the wall frame at a fixed angle before the trusses can be joined together to form a roof frame. At present, tie down apparatus are fitted to the roof truss and/or wall frame at the factory and are configured in a manner which allows for the roof truss to be fitted to the wall at a single angle. Existing tie down methods are thus prone to error because if the trusses arrive at a site and the tie down apparatus is fitted, configured or orientated incorrectly, the roof truss is not able to be fitted at the required angle. Such mistakes may result in prolonged assembly times, increased labour requirements, increased manufacturing, and ultimately more expense for the manufacturer and end consumer.

The Applicant is not aware of a truss tie down apparatus which allows for the fitting a roof truss to a wall frame at any angle (including during on-site assembly), nor of a system which allows for multi-angle tie down apparatus to be factory fitted to mass produced roof and wall trusses.

In addition, at the time of assembling conventional roof truss systems, the exact angle of each truss must be precise when fastened to the frame. If it is not, the trusses may not match up at a central location correctly. It is labour-intensive and time consuming to have to calculate and ensure each angle is correct, and there is presently no scope to adjust the position of the truss once it has been secured to the wall frame.

SUMMARY OF THE INVENTION

Therefore in one aspect there is proposed a roof truss tie down apparatus which enables the fitting of a roof truss to a wall frame at any angle relative to the wall frame.

In a further aspect said tie-down apparatus includes a tie down pin and receiving bracket, said tie down pin including a means of attachment to the truss and a downwardly extending male portion, said receiving bracket including a means of attachment to the wall frame and a female portion adapted to receive the male portion, such engagement enabling the fitting of the roof truss to the wall frame at any angle.

In an alternative aspect said tie down apparatus includes a tie down pin and receiving bracket, said tie down pin including a means of attachment to the wall frame and an upwardly extending male portion, said receiving bracket including a means of attachment to the roof truss and a female portion adapted to receive the male portion, such engagement enabling the fitting of the roof truss to the wall frame at any angle.

In a still further aspect said tie down apparatus includes a tie down pin having a means of attachment to the roof truss and a downwardly extending male portion, and a separator block adapted for mounting above the wall frame said separator block including a female portion adapted to receive the male portion, such engagement enabling the fitting of the roof truss to the wall frame at any angle and at a spaced apart distance from the wall frame said spaced apart distance corresponding with the height of the spacer block.

In a yet further aspect said tie down apparatus includes a separator block adapted for mounting above the wall frame said separator block including an upwardly extending male portion, and a receiving bracket including a means of attachment to the roof truss and a female portion adapted to receive the male portion, such engagement enabling the fitting of the roof truss to the wall frame at any angle and at a spaced apart distance from the wall frame said spaced apart distance corresponding with the height of the spacer block.

Alternatively said male portion is in the form of a cylindrical member and said female portion is in the form of an aperture or socket configured to receive the male portion.

Alternatively said male portion is in the form of a cylindrical member having an outwardly flanged tip that is inwardly deformable and said female portion is an aperture or socket shaped for engagement with the cylindrical member and flanged tip by snap fit.

In a still further aspect said male portion is in the form of a substantially cylindrical member including outwardly extending barbs, and said female portion is in the form of an aperture or socket including inwardly extending barbs of a deformable material to allow for insertion of the cylindrical member and subsequent rotation of the cylindrical member.

In another aspect said male portion is in the form of a pin including at least one barbed form along its length, and said female portion is in the form of one or more arched forms associated with a receiver plate, whereby once the pin is fully inserted the barbed forms engage upon a lower edge of the arch forms.

Alternatively said male portion is in the form of a cylindrical member including a first thread on an outer surface thereof, and said female portion is in the form of an aperture or socket including a second thread on an inner surface thereof, said first and second threads adapted for rotatable engagement.

In a further aspect there is proposed a roof truss including a tie down apparatus or part thereof as defined above.

In a still further aspect there is proposed a wall frame including a tie down apparatus or part thereof as defined above.

In another aspect there is proposed a building frame assembly including:

a vertical wall frame;

at least one roof truss; and a roof truss tie down apparatus as defined above.

In an even further aspect there is proposed a method of constructing a roof frame above a wall frame, said method including the steps of:

(a) constructing the wall frame including a plurality of vertical studs capped by an upper horizontal wall frame member;

(b) constructing each roof truss forming part of the roof frame;

(c) fitting each roof truss to a location along the upper horizontal wall frame member at a desired angle using the roof truss tie-down apparatus defined in any one of the above paragraphs.

It should be noted that any one of the aspects mentioned above may include any of the features of any of the other aspects mentioned above and may include any of the features of any of the embodiments described below as appropriate.

BRIEF DESCRIPTION OF THE DRAWINGS

The accompanying drawings, which are incorporated in and constitute a part of this specification, illustrate various implementations of the invention and, together with the description, serve to explain the advantages and principles of the invention. In the drawings.

DETAILED DESCRIPTION OF THE EMBODIMENTS

Figure 1C:
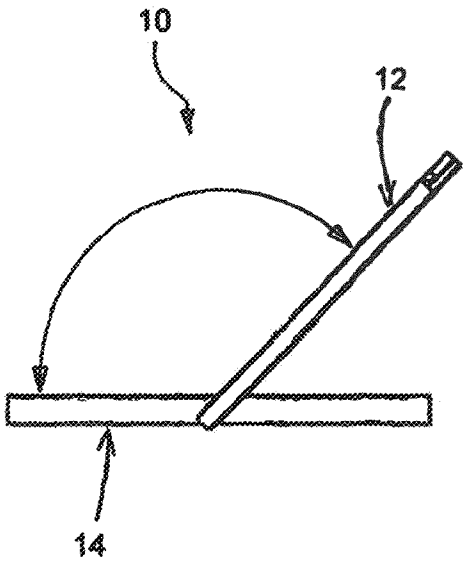
FIG. 1*c* is a top view of a wall frame and a roof truss attached thereto using the tie-down apparatus of FIGS. 1*a* and 1*b*, demonstrating the possible fitting of the roof truss to an angle of 135 degrees.

The following detailed description of the invention refers to the accompanying drawings. Wherever possible, the same reference numbers will be used throughout the drawings and the following description to refer to the same and like parts. Dimensions of certain parts shown in the drawings may have been modified and/or exaggerated for the purposes of clarity or illustration.

Wall frames and roof trusses in building construction are most commonly made from wood or metal. Such constructions include vertical wall frames and typically triangular trusses which form part of the frame of the roof, although roof trusses may come in a wide variety of shapes and sizes. This invention relates to an apparatus and method of fitting roof trusses to wall frames in a manner which allows any shape or form of roof truss to be fitted at any angle. Various additional benefits arise from use of the present invention, as described in more detail below.

Figure 1B:
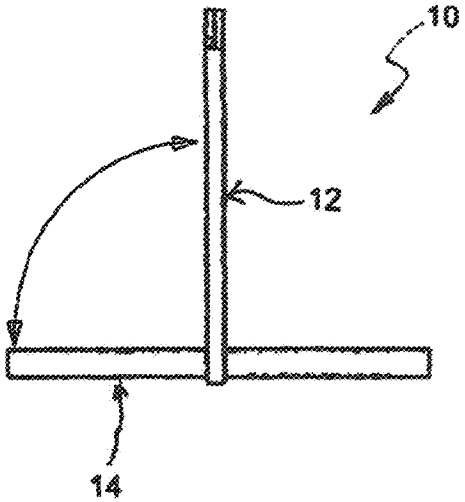
FIG. 1*b* is a top view a wall frame and a roof truss fitted thereto using the tie-down apparatus of FIG. 1*a*, demonstrating the possible fitting of the roof truss to an angle of 90 degrees.
Figure 1A:
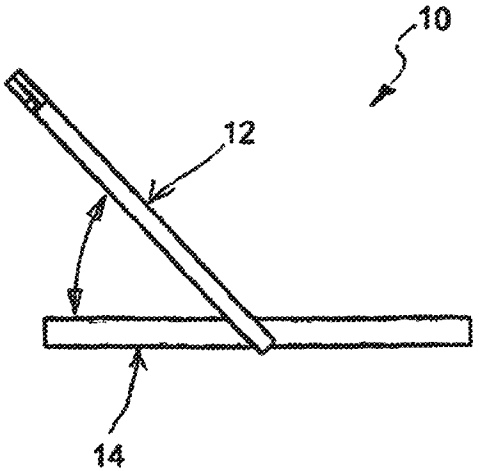
FIG. 1*a* is a top view a wall frame and a roof truss fitted thereto using a tie-down apparatus embodying the present invention, demonstrating the possible fitting of the roof truss to an angle of 45 degrees.

An aspect of the invention in its broad form is demonstrated in FIG. 1*a*, which shows a top view of a frame assembly 10 including a roof truss 12 fitted to the centre of a wall frame 14 at an angle of approximately 45 degrees from the wall frame 14. FIG. 1*b* shows the truss 12 fitted at a 90 degree angle from the frame 14, and FIG. 1*c* shows the truss 12 fitted at a 135 degree angle from the frame 14. The purpose of these drawings it to demonstrate to the reader how a roof truss and wall frame can be assembled such that the roof truss is fitted above the wall frame in a 360 degree range of angles.

Whilst the invention is not intended to be limited to any one means of enabling the roof truss to be tied down at a desired angle, it is achieved according to one aspect using a pin tie-down which involves the use of a vertical pin (or male member or shaft) associated with either the roof truss or wall frame, as embodied in the drawings and described in more detail below, and a corresponding socket means (or female portion) associated with the respective wall frame or roof truss, whereby engagement between the two components allows for the roof truss to be fitted at a desired angle above the wall frame.

The skilled addressee would understand the benefits of a system which allows a roof frame to be fitted to a wall frame at any desired angle. Such a system allows for the wall and roof frame, and the male and female portions of the tie down apparatus, to be mass produced and for much of the assembling of components to be completed on-site with minimal room for error. For example, a roof truss may be fitted with one or more male engagement portions and a wall frame may include one or more female engagement portions at corresponding positions along the frame, and each of these members would arrive at a site. After the wall frame is erected, an assembler can quickly and easily fit the truss at the desired angle above the wall frame by simply engaging the tie down components. From a manufacturing point of view, the potential for error due to incorrect fitment of "angle specific" tie-down components to each of the wall frame and roof truss in the factory is reduced.

The skilled addressee would further realize that where there is a plurality of trusses adapted to meet at a central location, for example, the invention allows each truss to be secured above the wall frames, rotated to their desired angle, and then fixed in position. This alleviates the requirement for accuracy when assembling each and every roof truss, and provides the builder with greater flexibility. However, it is to be understood that the present invention is not intended to be limited to the ability of the truss to rotate after the tie-down associated with one end thereof is engaged. There are many circumstances in which the ability to fit the roof truss at any angle, but for the roof truss to remain fixed at that angle after the tie down components are engaged, is desirable.

According to one aspect, the tie down apparatus not only allows the truss to be fitted at a desired angle, but also allows the truss to be separated a short vertical distance from the wall frame. The skilled addressee would appreciate that this separation provides a significant reduction in thermal bridging between the roof and wall structural elements. The benefits of reducing thermal bridging are well known in the art.

Figures 2A, 2B, 2C:
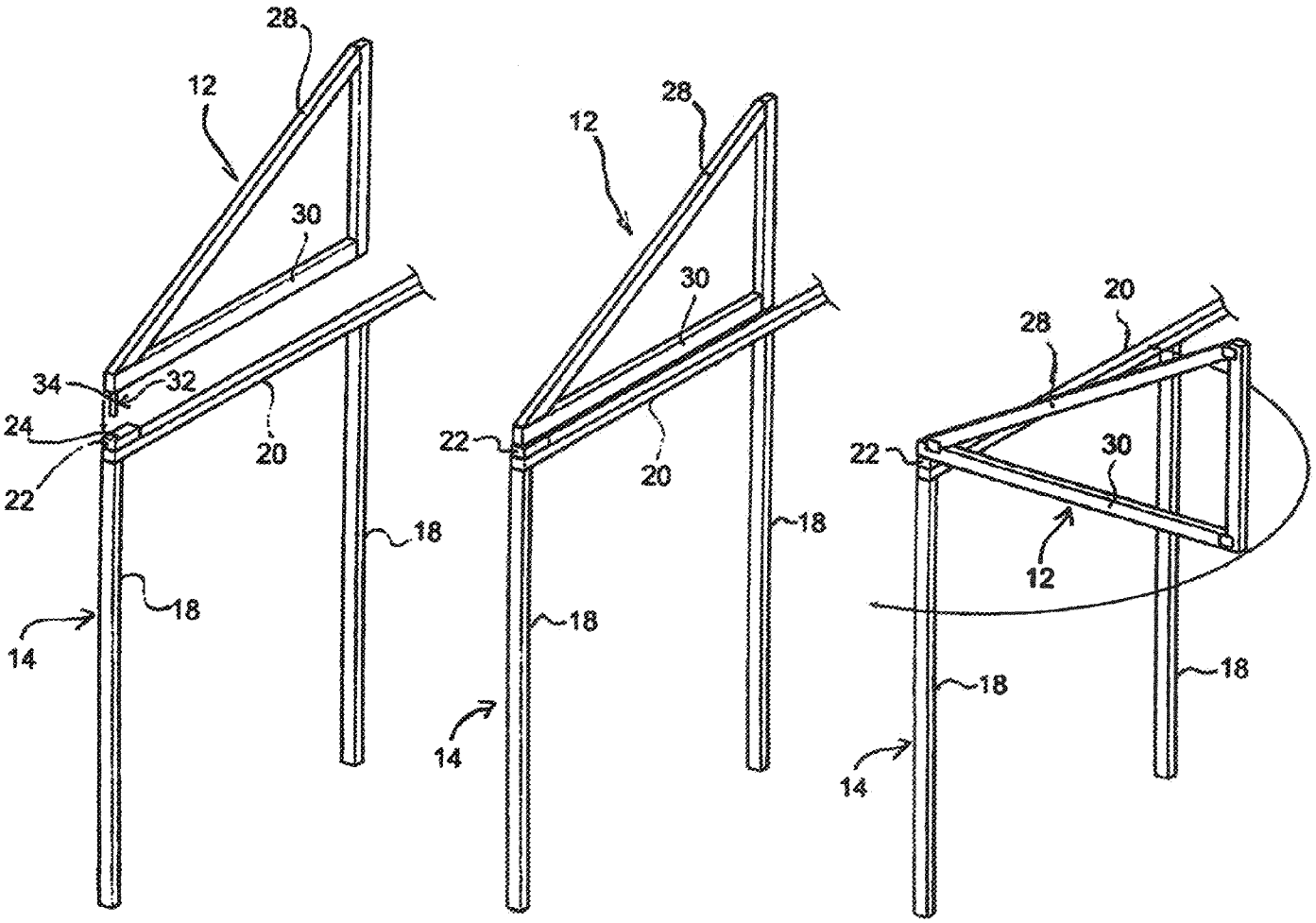
FIG. 2*a* is an exploded perspective view of a roof truss incorporating a pin tie-down which separates the roof truss from the wall frame in accordance with one embodiment of the invention.
FIG. 2*b* is an assembled perspective view of the roof truss tie down of FIG. 2*a;*
FIG. 2*c* is an assembled perspective view of the roof truss tie down of FIG. 2*a* demonstrating rotation of the roof truss to 90 degrees from the angle of the wall frame.
Figure 3:
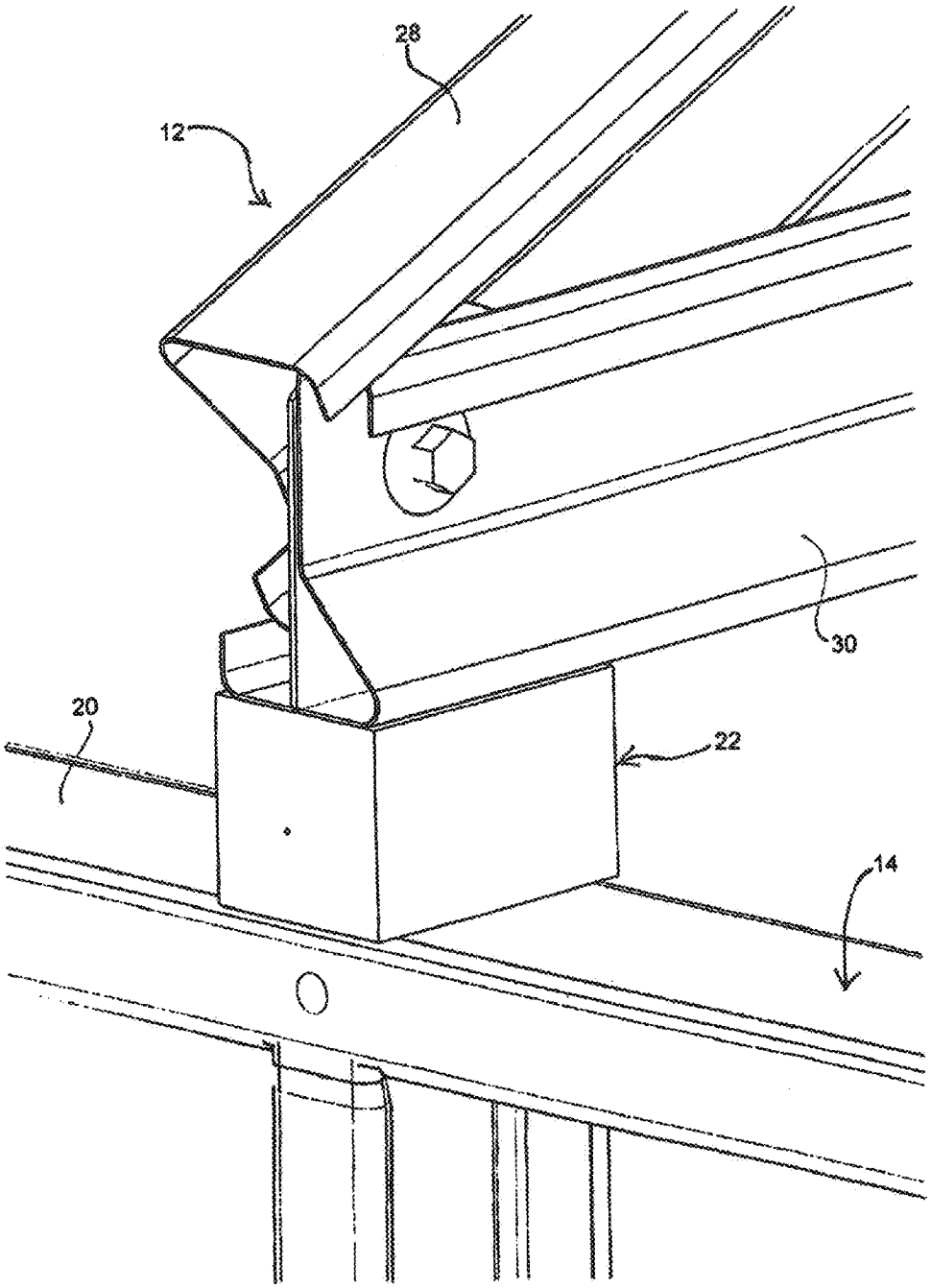
FIG. 3 is an enlarged perspective view of the block and adjacent components used in the roof truss tie down of FIGS. 2*a*-2*c;*

The invention according to this aspect is shown in FIGS. 2-3. There is shown a wall frame 14, made preferably of steel, including a number of vertical studs 18 and an upper horizontal element 20 extending across the top of the studs as per conventional wall frame design. The frame 14 could be made from other materials including but not limited to wood, brick, double brick, adobe or polymer.

Fixed above the wall frame element 20 is a truss tie-down separator block 22 in which the "socket means" of the tie down apparatus is incorporated, including a bore 24 extending from an upper surface thereof vertically down through the block. In one aspect, the bore 24 does not extend all the way through the block. The block 22 is attached to the wall frame at the desired point of attachment of the roof truss 12.

In the embodiment shown, the truss 12 is preferably comprised of one or more diagonal chord members 28 and a lower horizontal chord 30 in a bracing pattern to form a triangle shape. In the embodiment shown in FIGS. 2*a*-2*c*, the triangle is a right angled triangle including only one angled chord member 28, but other configurations are also feasible. The skilled addressee would understand that roof trusses are available in a wide variety of shapes and sizes, including barrel vault trusses, double cantilever trusses, sloping flat trusses and double inverted trusses, and it is to be understood that the present invention is not intended to be limited to any one shape or configuration. The truss 12 includes a pin 32 having a lower cylindrical portion 34 which extends downwardly from the lower chord 30 at the desired point of attachment to the wall frame 20.

The pin 32 can be bolted at its upper end through the truss 12 where the upper chord 28 intersects with the lower chord 30 such that the cylindrical portion 34 extends downwardly from the truss 26 and forms a 90 degree angle with the lower chord 30. One way of doing this is using the Applicant's existing bossed/pressed structural element connection system (not shown) as described in their International Patent Publication WO/2001/023684, although the invention is not intended to be limited to this method of connection. The pin 32 is preferably made from metal, but can be made from any sufficiently durable material.

Once the truss is aligned to a desired angle, the pin cylindrical portion 34 can be inserted into aperture 24 of the tie-down block 24 thereby engaging the tie-down components. Alternatively, as seen clearly in FIG. 2*b*, the truss can be adjusted to a desired angle after attaching the truss 26 to the wall frame 20, although this may not always be possible depending on the style of roof frame being erected. The tie-down components allow the truss to be fitted along a horizontal range of angles, including to an angle perpendicular to the wall frame as seen in FIG. 2*c* for example. FIG. 3 shows an enlarged view of a tie-down connection between roof truss and wall frame in accordance with this aspect of the invention.

Figure 4:
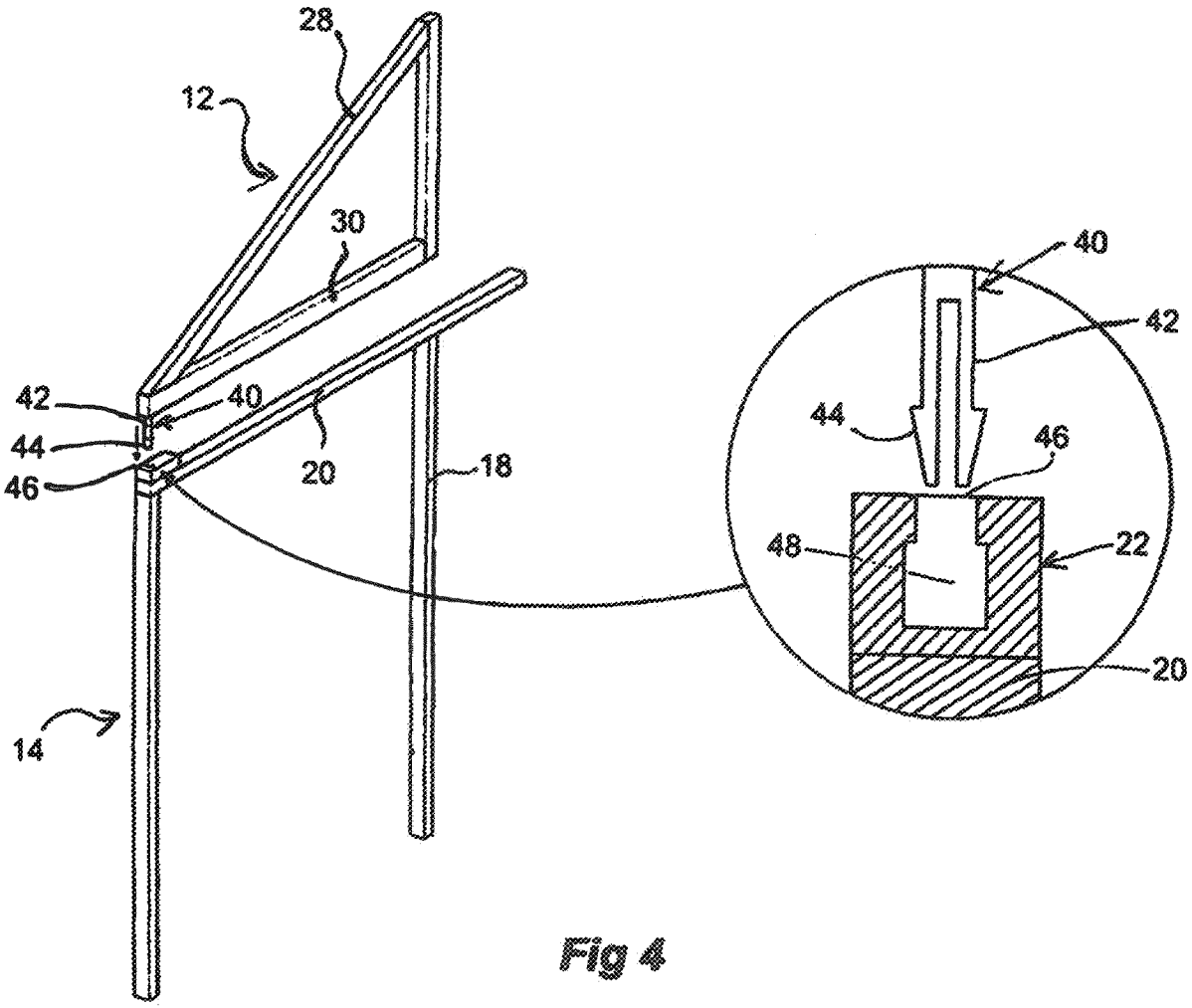
FIG. 4 is an exploded and enlarged perspective view of a roof truss incorporating a pin tie-down which separates the roof truss from the wall frame in accordance with a further aspect of the invention.

FIG. 4 demonstrates a still further aspect of the present invention. In particular, the truss includes a pin 40 associated therewith having a hollow, inwardly deformable cylindrical portion 42 with a lower tip 44 that is outwardly flanged. The pin 40 is adapted to be inserted into the block aperture 46 which is shaped to allow for the lower tip 44 to snap fit inside the aperture 46. In particular, the diameter of the aperture is not sufficient to allow insertion of the flanged tip 44 unless the cylindrical portion 42 is inwardly deformed, so once the tip 44 reaches region 48 of aperture 46, it is allowed to snap back to its original position and thereby lock the pin in the block aperture 46.

Figure 5B:
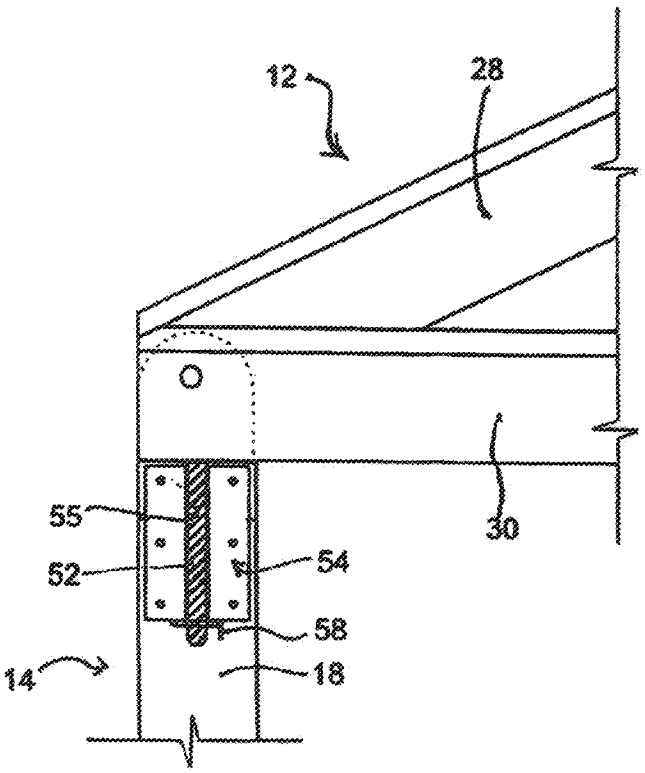
FIG. 5*b* is an assembled, side cross sectional view of the roof truss and pin tie-down of FIG. 5*a;*
Figure 5A:
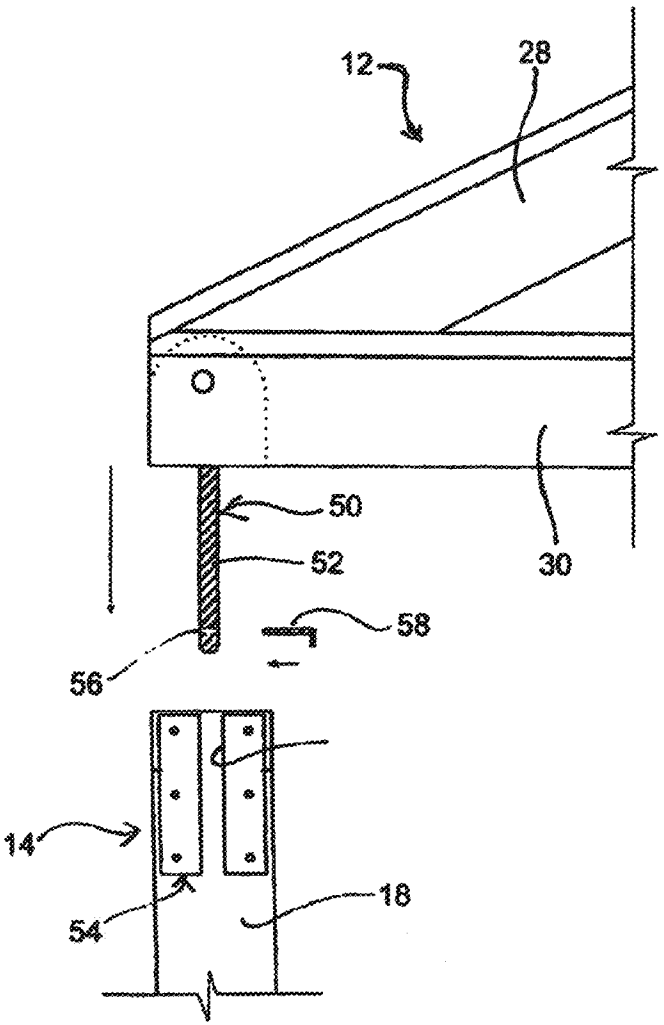
FIG. 5*a* is an exploded, side cross sectional view of a roof truss incorporating a pin tie-down for direct mounting to a wall frame bracket in accordance with a further embodiment of the present invention.

The present invention, according to a further embodiment, does not involve the use of a separator block but rather enables the direct fitting of the roof truss 12 to the wall frame 14 at any angle. This further embodiment of the invention can be viewed according to one aspect in FIGS. 5*a*-5*b*. In this aspect, the roof truss 12 is secured directly above the wall frame 14. Once again, there is a tie-down pin 50 associated with the roof truss which includes a lower cylindrical portion 52. Rather than being inserted into a block aperture, the cylindrical pin portion 52 is adapted for similar insertion into a bracket 54 fixed to one of the wall frame studs 18. Whilst only shown in cross section, it is to be appreciated that bracket 54 is shaped such that it includes a central rounded channel 55 which together with the surface of the stud provides what is essentially a socket through which cylindrical portion 52 can be rotatably accommodated. The upper portion of pin 50 can be connected to the truss using any suitable means as per the description of the earlier embodiment.

The cylindrical portion 52 may include an aperture 56 extending transversely there through adapted for receiving a locking pin 58. The bracket would be of a length such that when the pin is fully inserted, the aperture 56 is visible beneath the bracket to allow for insertion of the locking pin 58. The person skilled in the art would realize that the locking pin 58 thus prevents the tie down pin 50 from being raised out from the bracket 54 after the truss has been fitted. Such a pin could also be configured to prevent subsequent rotation of the truss after being fitted. An alternative to using a locking pin could be to use a circlip (not shown).

In a further aspect, after all trusses and walls have been assembled, an additional pin, screw, bolt or any other suitable locking device can be fitted which serves to not only tie the truss down, but also lock the brackets to the pins and stop any rotation.

Figure 6B:
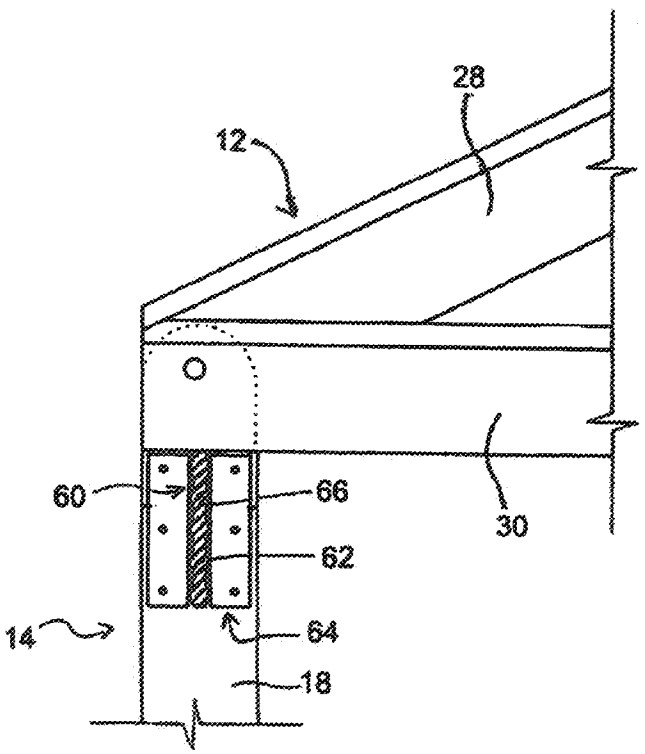
FIG. 6*b* is an assembled, side cross sectional view of the roof truss and pin tie-down of FIG. 6*a;*
Figure 6A:
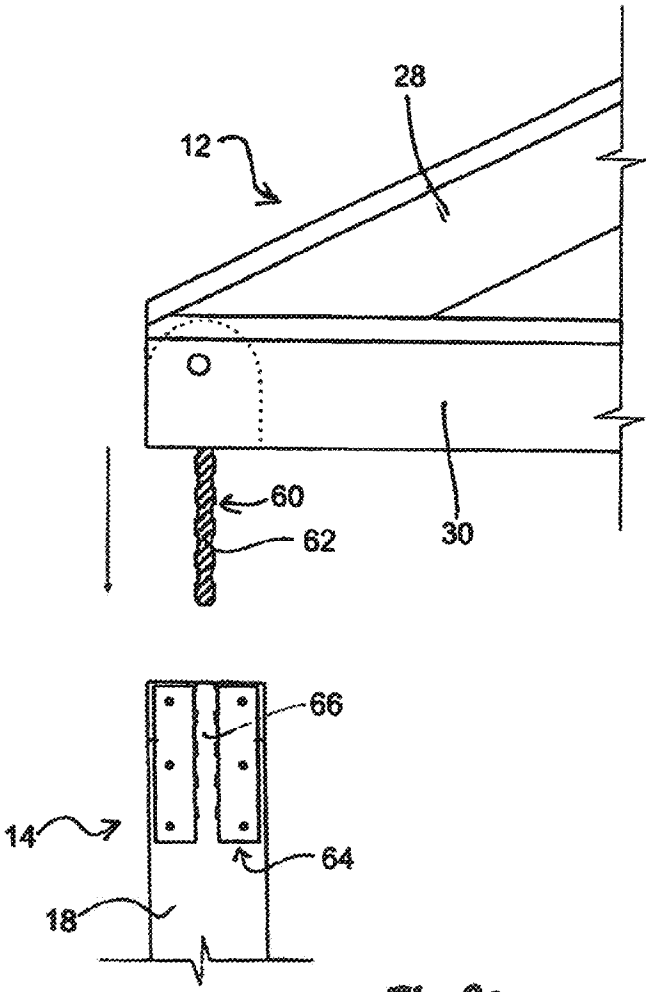
FIG. 6*a* is an exploded, side cross sectional view of a roof truss incorporating a pin tie-down for direct mounting to a wall frame bracket in accordance with a further aspect.

A further aspect, as shown in FIGS. 6*a*-6*b*, includes the use of a tie down pin 60 having a barbed cylindrical portion 62 and a bracket 64 secured to the wall stud 18 including a barbed channel 66. The pin 60 is bolted through the truss 12 at its upper end (as described earlier) and the barbed cylindrical portion 62 is adapted to be inserted inside the channel 66 at any roof truss angle.

The barbs inside channel 66 may be made from a deformable material such as plastic, spring steel or other, which allows the rigid barbed pin 60 to be inserted into the channel 66 and then secured by the mating arrangement of the barbs as shown. Alternatively, the channel 66 could be outwardly deformable to allow for insertion but adapted to snap back into their original position thereafter. In such a configuration, the barbs on the pin 60 could be angled upwards in a triangular shape and the barbs inside the bracket 64 could be angled downwardly, thereby facilitating insertion.

Figure 7B:
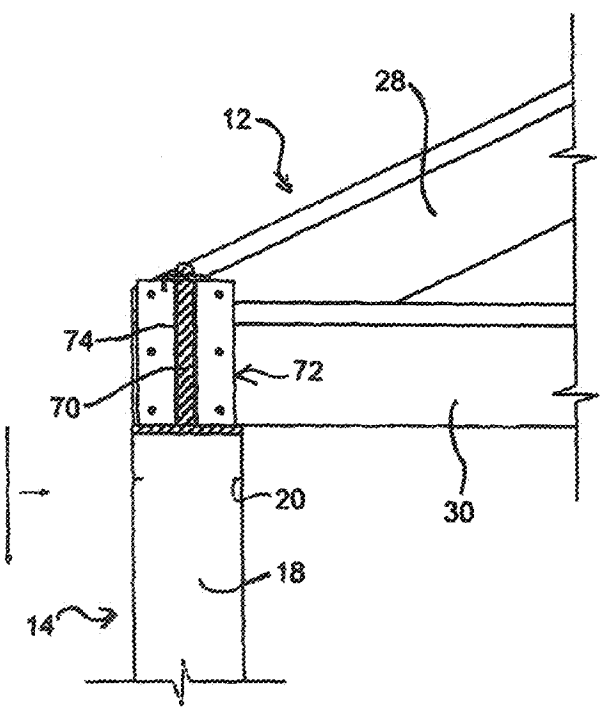
FIG. 7*b* is an assembled, side cross sectional view of the roof truss and pin tie-down of FIG. 7*a;*
Figure 7A:
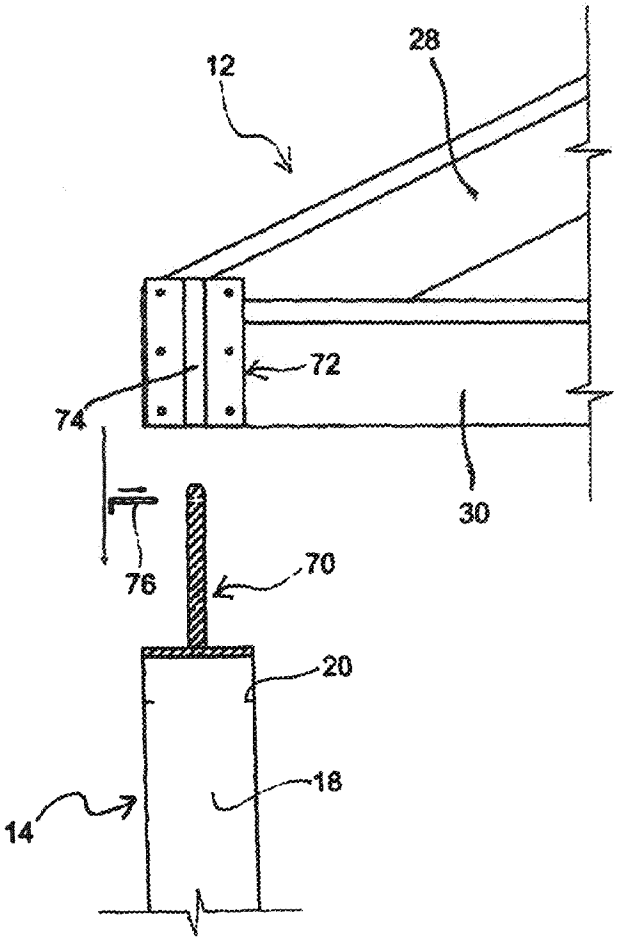
FIG. 7*a* is an exploded, side cross sectional view of a roof truss incorporating a pin tie-down for direct mounting to a wall frame in accordance with a still further aspect.

It is to be understood that the reverse configuration of the above described configurations is also possible in that the male portion of the tie down apparatus could be associated with the wall frame and the female portion associated with the roof truss. Such an aspect is shown in FIGS. 7*a*-7*b* which utilizes a pin 70 extending upwardly from wall frame member 20. The truss 12 now incorporates the bracket 72 as described in previous embodiments and is adapted to be lowered onto the pin 70 at any angle such that the pin extends through the bracket channel 74. A locking pin 76 may be used again to lock the bracket 72 to the tie-down pin 70. Again, various alternatives are possible including the barbed pin/bracket channel aspect described earlier.

A further variation which is not shown is the use of a spacer block such as spacer block 22 having a male portion extending upwardly therefrom and adapted to be received in a socket defined by a bracket such as bracket 72 attached to the roof truss.

A still further embodiment, which is again not shown but could be applied to either the normal or reverse tie down configurations mentioned above, is the use of a threaded pin and threaded locking nut engagement which would also rotatably secure the truss to the wall frame.

Figure 8A:
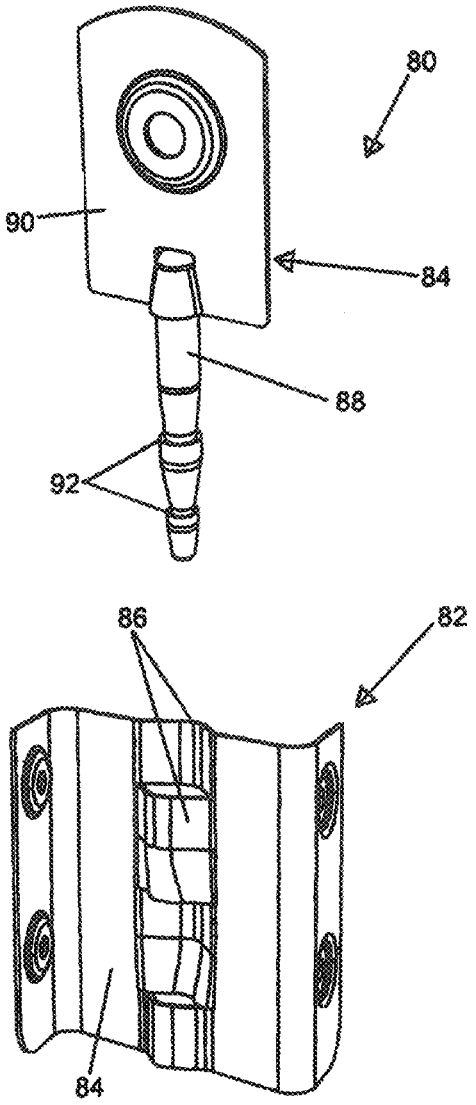
FIG. 8*a* is an exploded perspective view of a roof truss tie down apparatus including a bracket and pin fitment according to a yet further aspect.
Figure 8B:
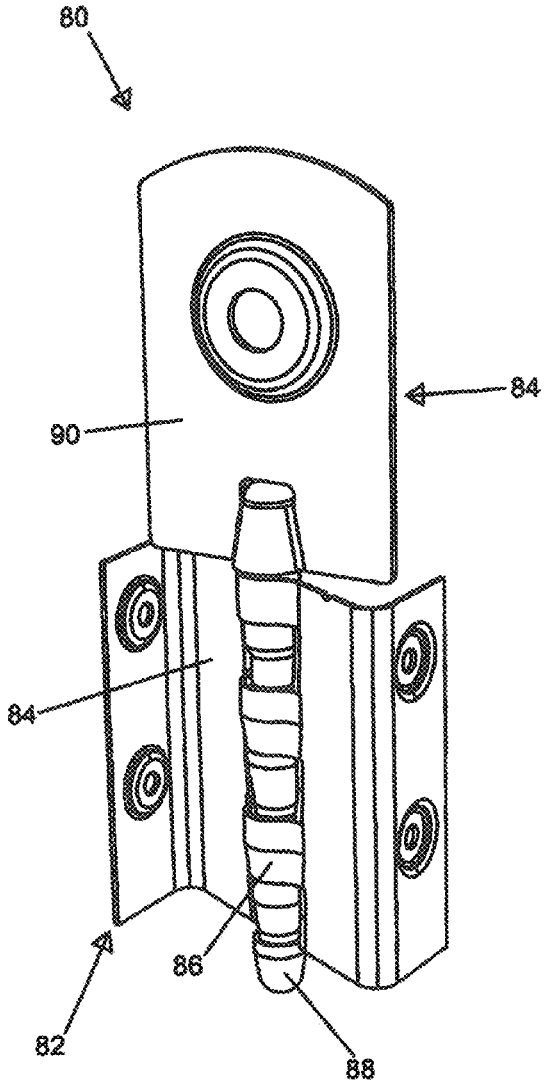
FIG. 8*b* is an assembled perspective view of the roof truss tie down apparatus of FIG. 8*a.*

FIGS. 8*a* and 8*b* show a tie down apparatus 80 including a bracket 82 and pin/tab 84 configured according to another aspect of the invention. The addressee would understand that the apparatus 80 is similar to that previously described in FIGS. 6*a*-6*b* but including some additional features. The bracket 82 includes a receiver plate 84 configured for bossed connection to structural members of a wall frame, having pressed metal formings to create louvred arches 86 on each side of the central plate 84. The pin/tab 84 includes a pin portion 88 suspended from a tab 90 which is configured for bossed connection to a roof truss structural member. The arches 86 of the bracket 82 are designed to spring slightly apart to allow the pin portion 88 to be inserted into the receiver under low installation loads. The receiver plate 84 may be constructed of spring steel or any other suitably flexible material. Once fully inserted, the barbed forms 92 on the pin portion 88 engage upon the lower edge of the arch forms locking the two components together in a manner that provides a very high pullout resistance.

Thus, in the tie-down apparatus of FIGS. 6*a*-6*b* and 8*a*-8*b*, the pins are configured not only as a means of locating a truss in position, but are utilized as structural members in that that they assist in resisting pull out, racking loads, etc.

In some situations, the inside of the wall frame will not be accessible, for example, the wall frame may be filled with foam or other material used to fire rate/insulate the frame. In these circumstances, the tie down apparatus associated with the wall frame may be encapsulated and not visible from the outside of the bracket and therefore not accessible to tie the truss down. In these circumstances, it may be necessary to perform a "blind fixing", that is, insertion of a pin into the foam material until the pin engages the bracket encapsulated by the foam. The skilled addressee would understand that such a scenario will require the two tie-down components to engage without the use of additional fixings. The barbed configurations of FIGS. 6*a*-6*b* and 8*a*-8*b* are both suitable, but other variations may be feasible.

The present invention thus provides for a simplified method of building construction involving wall frames and roof trusses which can be mass produced, as well as bracket and pin tie-down apparatus which can also be mass produced and which, importantly, enable the roof trusses to be fitted at any angle relative to the wall frames during assembly. For example, each of the wall frame components, the roof truss components, and the bracket and pin components forming the tie-down apparatus of a building structure is adapted to be predetermined and pre-punched using computer aided design and automated machinery. It is envisaged that each of the wall frame and roof truss structural members will be marked in some way in accordance with building plan data which has been input into the machinery. This would assist an assembler in the factory in identifying at what points along a roof truss or wall frame to fit a tie-down component.

Each of the wall frames and roof trusses can thus be fitted with the tie-down components in the factory, eliminating the need for site assembly, although on-site assembly is still considered to be within the scope of the invention. The result of implementing the present invention is that the manufacture, assembly, transport and construction of building frames becomes far more simplified and efficient.

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

In any claims that follow and in the summary of the invention, except where the context requires otherwise due to express language or necessary implication, the word "comprising" is used in the sense of "including", i.e. the features specified may be associated with further features in various embodiments of the invention.

Any discussion of the prior art throughout the specification should in no way be considered as an admission that such prior art is widely known or forms part of the common general knowledge in this field.

The invention claimed is:

1. A roof truss tie-down apparatus wherein said apparatus enables the fitting of a roof truss to a wall frame; the tie-down apparatus permitting the roof truss to be rotated relative to the wall frame about a vertical axis extending through the tie-down apparatus and to be rotated through every angle up to 360° in a horizontal plane; and to be selectively oriented relative to the wall frame at every angle in that 360° rotation; wherein the roof truss tie-down apparatus comprises:

a tie-down pin secured to one of the roof truss or the wall frame; and a receiving bracket secured to the other of the roof truss or the wall frame;

wherein the tie-down pin comprises a first plate having a first end and a male portion extending outwardly from the first end; wherein the first plate is adapted to be secured to the one of the roof truss or the wall frame by a fastener; and wherein the male portion of the tie-down pin is engageable in the receiving bracket.

2. The roof truss tie-down apparatus as defined in claim 1, wherein said tie-down apparatus is attachable to the roof truss and the male portion is a downwardly extending male portion, and wherein said receiving bracket is attachable to the wall frame and includes a female portion that receives the male portion, such engagement enabling the fitting of the roof truss to the wall frame.

3. The roof truss tie-down apparatus as defined in claim 2, wherein said male portion is in the form of a cylindrical member and said female portion is in the form of an aperture or socket configured to receive the male portion.

4. The building frame assembly as defined in claim 1, wherein the roof truss comprises:

an upper chord member; and a lower chord member;

wherein the first plate of the roof truss tie-down apparatus is boltable to the upper chord member and the lower chord member of the roof truss at a location where the upper chord member intersects with the lower chord member thereby serving to attach the upper chord member and the lower chord member together.

5. The building frame assembly as defined in claim 4 wherein pin of the tie-down pin extends downwardly from the lower chord member of the roof truss and forms a ninety degree angle with the lower chord member.

6. A roof truss tie-down apparatus wherein said apparatus enables the fitting of a roof truss to a wall frame; where the roof truss has an upper chord member and a horizontal lower chord member; and the wall frame has a horizontal top beam, a horizontal bottom beam and one or more vertical beams extending between the top and bottom beams; and wherein the tie-down apparatus comprises:

a tie-down pin including a male portion; wherein said tie-down pin is adapted to be engaged with the roof truss;

a receiving bracket comprising a plate defining a female portion therein; and wherein the receiving bracket is adapted to be engaged with the horizontal top beam of the wall frame;

wherein the male portion of the tie-down pin is receivable in the female portion of the receiving bracket;

wherein the roof truss tie-down apparatus permits the roof truss to be rotated relative to the wall frame about a vertical axis extending along the male portion of the tie-down pin; said roof truss being rotatable through an angle of up to 360° in a horizontal plane and relative to the wall frame;

wherein the roof truss is selectively fixable to the wall frame at every angle in that 360° rotation; and wherein the tie-down pin is adapted to attach the upper chord member of the roof truss to the lower chord member of the roof truss.

7. The roof truss as defined in claim 6, wherein the tie-down pin comprises:

a first plate having opposed first and second sides that define a hole therethrough; wherein the hole is adapted to receive a fastener therethrough to secure the first plate to the roof truss; wherein the first plate has a first end oriented at right angles to the first and second sides; and wherein the male portion comprises a pin that is integral with and extends outwardly from the first end of the first plate; said pin being oriented at right angles to the first end.

8. The roof truss tie-down apparatus as defined in claim 7, wherein the plate of the receiving bracket is adapted to be secured to the wall frame by one or more fasteners; and wherein the plate has a first end and a second end and the female portion comprises a channel defined in the plate and extending inwardly from a first end of the plate towards a second end of the plate and wherein the channel is complementary to the pin of the tie-down apparatus.

9. A roof truss tie-down apparatus wherein said apparatus enables the orienting of a roof truss relative to a wall frame; the tie-down apparatus comprising:

a tie-down pin engaged with one of the roof truss and the wall frame; and a receiving bracket engaged with the other of the roof truss and the wall frame;

wherein the tie-down pin comprises a first plate having a first end with a pin extending outwardly therefrom; and wherein the pin is oriented at right angles to the first end;

wherein the receiving bracket comprises a second plate having a first end and a second end; and the second plate defines a channel therein that extends from the first end of the second plate towards the second end of the second plate;

wherein the first end of the first plate is substantially smooth and the first end of the second plate is substantially smooth; and wherein the first end of the first plate contacts the first end of the second plate;

wherein the first end of the first plate and the first end of the second plate rotate freely relative to each other and permit the roof truss to rotate relative to the wall frame through every angle up to 360° in a horizontal plane; and permit the roof truss to be selectively oriented relative to the wall frame at any one of every angle in the 360° rotation.

10. The roof truss tie-down apparatus as defined in claim 9, wherein the pin of the tie-down pin defines a hole therethrough that is parallel to the first end of the first plate; and wherein the roof truss tie-down apparatus further comprises a locking fastener that is receivable through the hole when the pin is received in the channel of the second plate.

* * * * *